US007195094B2

(12) United States Patent
Street et al.

(10) Patent No.: US 7,195,094 B2
(45) Date of Patent: Mar. 27, 2007

(54) VIBRATION REDUCTION APPARATUS

(75) Inventors: Steve Street, Dickson, TN (US); Laramie Mixon, Lexington, TN (US); Mackie Lane Walker, Lawrenceburg, TN (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 241 days.

(21) Appl. No.: 10/768,712

(22) Filed: Feb. 2, 2004

(65) Prior Publication Data

US 2004/0217253 A1 Nov. 4, 2004

Related U.S. Application Data

(60) Provisional application No. 60/444,173, filed on Feb. 3, 2003.

(51) Int. Cl.
*B60K 5/00* (2006.01)

(52) U.S. Cl. ..... 180/300; 180/291; 248/638

(58) Field of Classification Search ..... 123/192.2, 123/192.1; 248/638; 56/12.6
See application file for complete search history.

(56) References Cited

U.S. PATENT DOCUMENTS

| | | | | | |
|---|---|---|---|---|---|
| 1,831,628 | A | * | 11/1931 | Kuenzel | 248/638 |
| 1,991,579 | A | * | 2/1935 | Sampson | 248/605 |
| 3,457,804 | A | * | 7/1969 | Harkness | 74/604 |
| 3,776,354 | A | * | 12/1973 | Duclo et al. | 180/296 |
| 3,825,090 | A | * | 7/1974 | Runkle et al. | 180/292 |
| 4,015,407 | A | | 4/1977 | Bacon | |
| 4,240,517 | A | * | 12/1980 | Harlow et al. | 180/295 |
| 4,391,041 | A | | 7/1983 | Porter-Bennett | |
| 4,412,597 | A | * | 11/1983 | Aiba | 180/228 |
| 4,487,285 | A | * | 12/1984 | Tomita et al. | 180/228 |
| 4,779,834 | A | * | 10/1988 | Bittner | 248/638 |
| 4,825,548 | A | | 5/1989 | Driggers | |
| 5,035,397 | A | * | 7/1991 | Yamada | 248/638 |
| 5,526,781 | A | * | 6/1996 | Sugiyama et al. | 123/195 C |
| 5,570,757 | A | * | 11/1996 | Courtwright et al. | 180/291 |
| 6,053,272 | A | | 4/2000 | Koyanagi et al. | |
| 6,170,179 | B1 | | 1/2001 | Paytas | |
| 6,234,268 | B1 | * | 5/2001 | Savage et al. | 180/300 |
| 6,328,023 | B1 | * | 12/2001 | Sage | 123/559.1 |
| 6,328,274 | B1 | * | 12/2001 | Hayashi | 248/638 |
| 6,374,939 | B1 | * | 4/2002 | Hohnstadt et al. | 180/299 |
| 6,431,535 | B1 | * | 8/2002 | Volpe | 269/47 |
| 6,619,640 | B1 | * | 9/2003 | Ploski | 269/17 |
| 6,959,780 | B2 | * | 11/2005 | Oshima et al. | 180/299 |
| 2002/0152646 | A1 | | 10/2002 | Hanafusa | |
| 2003/0000761 | A1 | | 1/2003 | Fournier et al. | |

* cited by examiner

*Primary Examiner*—Christopher Bottorff
(74) *Attorney, Agent, or Firm*—Michael Best & Friedrich LLP

(57) ABSTRACT

A vibration reduction apparatus for an engine. The vibration reduction apparatus being incorporated into an engine mounting assembly as a connecting member. The engine mounting assembly including an engine block fastened at its bottom to an engine mounting structure, and the connecting member being connected between the engine block and the engine mounting structure. The connecting member is fastened to both the engine block and the engine mounting structure to further secure the engine to the engine mounting structure and to reduce vibrations caused by the engine on to the engine mounting structure.

5 Claims, 9 Drawing Sheets

VIBRATION REDUCTION APPARATUS

The present application claims priority to U.S. Provisional Application of Street et al., Ser. No. 60/444,173 filed Feb. 3, 2003, the entirety of which is hereby incorporated into the present application by reference.

FIELD OF THE INVENTION

The present invention relates reducing vibration in machines, tools, and vehicles powered by engines. Illustrative embodiments of the present invention relate to methods and apparatus for reducing vibrations in tools and machines powered by small internal combustion engines, such as snow throwers.

BACKGROUND

Many machines and tools (e.g., snow throwers, lawn mowers, garden tillers) are powered by small engines. These types of machine typically include an internal combustion (IC) engine mounted on a frame. The running engine causes machine vibration which is undesirable in may instances. High levels of vibration may, for instance, reduce the usable life of a machine and/or may make the machine more difficult for a machine operator to handle and control. Further, machine vibrations may be unpleasant for the operator during use.

SUMMARY

One aspect of the invention may be embodied in an engine mounting assembly comprising an engine block including an engine bottom surface having an engine bottom fastening element and an engine side surface having an engine side fastening element, the engine bottom surface being transverse to the engine side surface. The engine mounting assembly further includes an engine mounting structure that includes a mount upper surface having a mount upper fastening element and a mount side surface having a mount side fastening element, the engine bottom fastening element being fastened to the mount upper fastening element and the mount upper surface being transverse to the mount side surface. A connecting member is coupled between the engine block and the engine mounting structure, the connecting member having a first connecting member fastening element and a second connecting member fastening element, the first connecting member fastening element being fastened to the engine side fastening element and the second connecting member fastening element being fastened to the mount side fastening element.

Another aspect of the invention may be embodied in a connecting member for securing an engine to an engine mounting structure, comprising an engine portion having two block connector apertures, and an open-ended slot positioned between the two block connector apertures, the slot having a perimeter that is open at one end, each of the two block connector apertures having an axis extending therethrough and the slot being constructed and arranged such that a line intersecting each of the axes also passes through the slot. The connecting member further includes an engine mount portion that includes two mount connector apertures.

Another aspect of the invention may be embodied in an engine mounting assembly, comprising an engine block including an bottom surface and an engine side surface, the engine bottom surface being transverse to the engine side surface; a drive shaft extending from the engine block; an engine mount including an upper surface and a mount side surface; a connecting member coupled between the engine block and the engine mount, the connecting member fastened to the engine side surface by first fasteners and the connecting member fastened to the mount side surface by second fasteners, and the first fasteners being positioned on opposite sides of the drive shaft.

Other aspects, features, and advantages of the present invention will become apparent from the following detailed description of the illustrated embodiments, the accompanying drawings, and the appended claims.

DETAILED DESCRIPTION OF ILLUSTRATED EMBODIMENTS

The present invention is generally directed to the construction and operation of machines and tools that incorporate small engines. Some of the aspects of the invention are illustrated through the examination of the construction of a snow thrower, but the scope of the present invention not intended to be limited to snow throwers. Principles of the present invention can be applied to the construction of a wide range of types of power operated equipment, for example, or can be applied to the mounting of may types of engines on may types of engine mounting assemblies.

Figure 1:
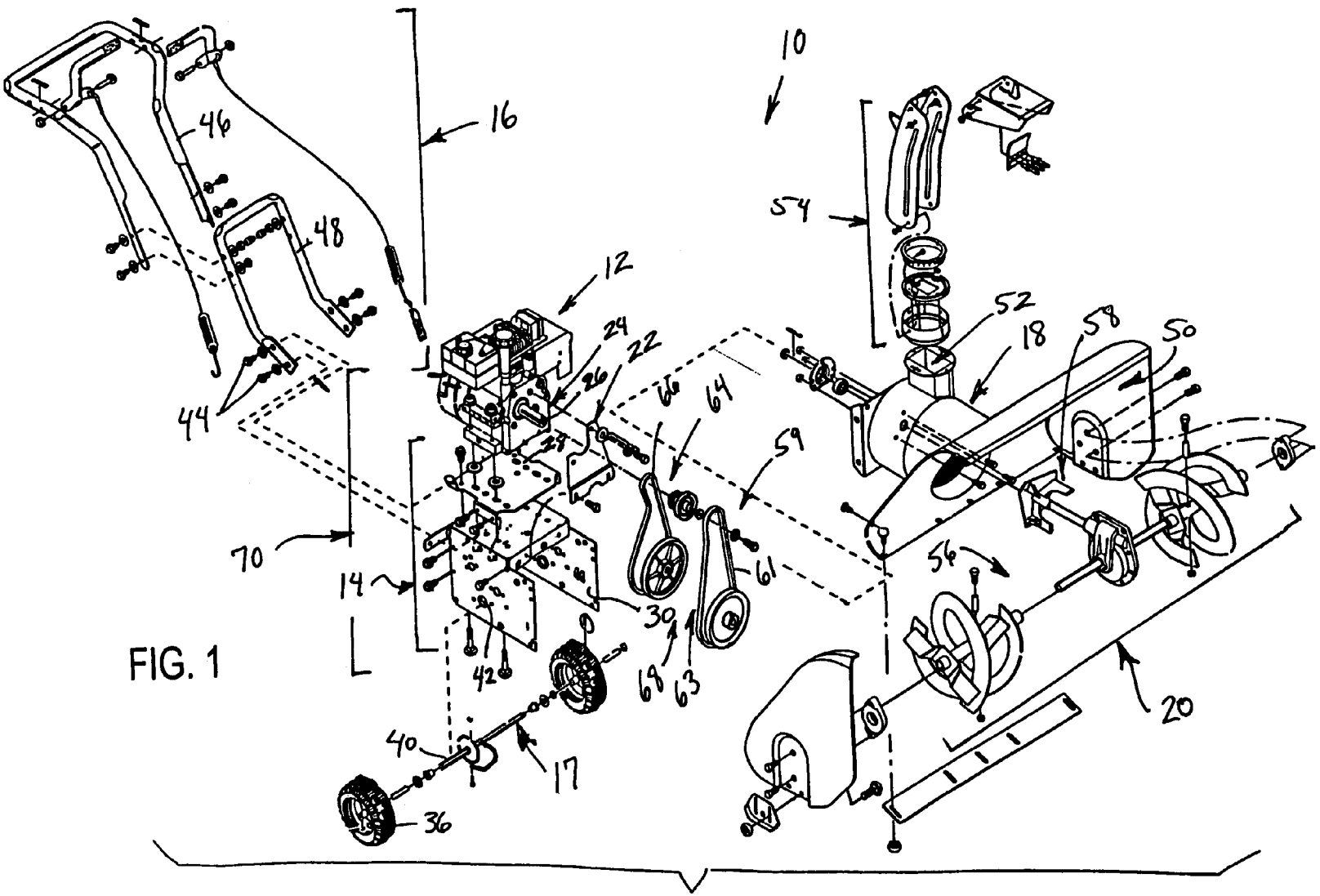
FIG. 1 is an exploded view of the major structural components of a snow thrower in accordance with one illustrative embodiment of the present invention.

FIG. 1 shows one illustrated embodiment of the invention as applied to a snow thrower 10. The snow thrower 10 includes an internal combustion engine 12, an engine mounting structure or frame 14, a handle assembly 16, a wheel assembly 17, a snow collection and discharge housing 18, and a snow collection and discharge mechanism 20.

The engine 12, the handle assembly 16, the wheel assembly 17 and the housing 18 are mounted to the frame 14. During operation of the snow thrower 10, an operator grips the handle to steer and control the snow thrower 10. Operation of the running engine 12 causes the snow thrower 10 to vibrate. For example, operation of the engine 12 produces vibrations which are transmitted through the frame 14 to all the components of the snow thrower 10, including the handle assembly 16. A vibration reducing structure or connecting member 22 is coupled between the engine 12 and to the frame 14 and is operable to reduce the amount of vibration transmitted from the engine 12 to other portions of the snow thrower 10, including to frame 14 and to the handle assembly 16. Reducing the vibration level in the snow thrower 10 has several advantages including, for example, increasing the service life of the snow thrower 10 and making the snow thrower 10 easier to operate. Reducing the vibrations in the handle assembly 16, in particular, has numerous benefits including, for example, increasing operator comfort, making control of the snow thrower 10 easier, and making it easier for an operator to use the snow thrower 10 for a prolonged period of time.

The engine 12 may be a two- or four-cycle gasoline powered engine. The engine 12 includes an engine block 24 and a drive shaft 26 rotatably mounted in the engine block 24. The drive shaft 26 is positioned within the engine block 26 and protrudes outwardly from the engine block 26 from a drive shaft opening 27 in the engine block 26. During operation of the engine 12, the drive shaft 26 rotates with respect to the engine block 24 to provide a torque which powers the operation of the snow thrower 10 including movement of the snow thrower 10 as well as its snow throwing capabilities.

The frame 14 includes an upper frame structure 28 and a lower frame structure 30. Each frame structure 28, 30 is an integral structure constructed of a metal of suitable strength such as steel or aluminum. Each frame structure 28, 30 may be formed by a sheet of metal that has been shaped by stamping or other method. Each frame structure 28, 30 includes a plurality of openings which serve as points of attachment for the various structures of the snow thrower 10. The frame structure 28, 30 and the engine 12 may be secured to one another using threaded fasteners such as nuts 32 and bolts 34 (not shown in FIG. 3 to more clearly illustrate features of the invention). A push retainer 36 may be mounted about each bolt 34 between the engine 12 and the frame 14.

The wheel assembly 17 includes a pair of ground engaging wheels 38 mounted on opposite ends of an axle 40. The axle 40 is rotatably mounted in a pair of aligned openings 42 formed in opposite sides of the lower frame structure 30. The wheels 38 are operatively coupled to the drive shaft 26 of the engine 12 for power operated forward and reverse movement of the snow thrower 10 over the ground.

The handle assembly 16 is secured to the lower frame structure 30 utilizing bolts 44. The handle assembly 16 is comprised of a pair of first and second tubular metallic handle sections 46, 48, respectively, each of which has a generally inverted U-shaped structure.

The illustrative snow collection housing 18 is a multi-piece structure constructed of a plurality of sheet metal components that have been shaped by stamping or other appropriate method and secured to one another. The components of the housing 18 may be secured to one another utilizing fasteners and/or by welding and/or by other appropriate method. The housing 18 has a snow-receiving front opening 50 and a exit opening 52 through which snow is discharged. A chute assembly 54 is rotatably mounted on the exit opening 52 of the housing 18.

The snow collection and discharge mechanism 20 includes an auger assembly 56 and an impeller structure 58. The auger assembly 56 and the impeller structure 58 are operatively coupled to the drive shaft 26 of the engine 12 through a coupling mechanism 59 which includes an auger drive belt 61 and plurality of pulleys generally designated 63. The coupling mechanism 59 includes an auger clutch mechanism.

When the auger clutch mechanism is engaged, the auger assembly 56 and the impeller structure 58 both rotate. The rotating auger assembly 56 receives snow that enters the opening 50 in the housing 18 and moves the snow onto the rotating blades of the impeller structure 58. The impeller structure 58 is positioned adjacent the exit opening 52 and operates to throw the snow received from the auger assembly 56 outwardly through the exit opening 52. The chute assembly 54 directs the snow discharged through the exit opening 52 to the desired location such as a snow bank.

The wheels of the wheel assembly 17 can be operatively coupled to the drive shaft 26 by a coupling mechanism 64 which includes a wheel assembly drive belt 66 and a plurality of pulleys generally designated 68. The coupling mechanism 64 includes a wheel assembly clutch mechanism. When the wheel assembly clutch assembly is engaged, power from the engine 12 rotates the wheels.

The snow thrower 10 may include a plurality of control mechanisms for controlling the operation of the snow thrower 10. These control mechanisms are not shown because the construction and operation of each is well know to one of ordinary skill in the art. For example, the snow thrower 10 may include control mechanisms for starting and stopping the engine, for controlling engine speed, for engaging and disengaging the clutch mechanisms associated with the wheel assembly 17 and the auger assembly 56, for controlling the operation of the chute assembly 54, for reversing the driving direction of the wheel assembly 17, and so on. The basic structure and operation of snow thrower 10, except for the vibration reducing structure 12 and its interconnection with the other parts of snow thrower 10, including its connection to the engine 12 and the frame 14 are generally known in the art by those of ordinary skill in the art. Examples of snow thrower 10 construction and operation are illustrated in U.S. Pat. No. 6,170,179 to Paytas et al. and in U.S. Patent Application Publication Number 2002/0,152,646-A1 of Hanafusa, each of which is hereby incorporated herein in its entirety by reference thereto, respectively.

The engine 12, the engine mounting structure or frame 14, and the connecting member 22 comprise an engine mounting assembly 70. The engine mounting assembly 70 and some of the components of the coupling mechanisms 59, 64 of the snow thrower 10 are shown in enlarged view in FIGS. 2 and 3. The engine block 26 of the engine mounting assembly 70 includes an engine bottom surface 72 having an engine bottom fastening element 74 and an engine side surface 76 having an engine side fastening element 78. The engine bottom fastening element 74 is comprised of a plurality of engine block bottom openings 73 extending into the engine block 26. The engine side fastening element 78 is comprised of a pair of engine block openings 75 in the side of the engine block 26. The engine bottom surface 72 is substantially transverse to the engine side surface 76. In the illustrative embodiment, the engine bottom surface 72 is substantially perpendicular to the engine side surface 76, but this is illustrative only and not intended to be limiting.

The engine mounting structure 14 includes a mount upper surface 80 and a mount side surface 81. The mount upper surface 80 is substantially transverse to the mount side surface 81. More specifically, the mount upper surface 80 is substantially perpendicular to the mount side surface 81, but this is illustrative only and not intended to be limiting. The mount upper surface 80 includes a mount upper fastening element 82 in the form of a plurality of openings 83 (see FIG. 2, for example). The mount side surface 81 includes a mount side fastening element 84 in the form of a pair of openings 85. It can be appreciated that each opening 83 of the mount upper fastening element 82 is comprised of an opening through the upper frame structure 28 and an opening through the lower frame structure 30. These openings are aligned with one another when the upper and lower frame structures 28, 30 are secured to one another to form the openings 83 that comprise the mount upper fastening element 82. The engine bottom fastening element 74 on the engine block 26 is fastened to the mount upper fastening element 82 on the engine mounting structure 14. In the illustrative embodiment, the elements 74, 82 are fastened to one another using fasteners such as bolts 34 and nuts 32.

The connector member 22 is secured to the engine mounting structure 14 in two places and the connector member 22 is secured to the engine side surface 76 in two places on generally opposite sides of the drive shaft 26. The connector member 22 is removably secured to the engine block 26 and to the engine mounting structure 14 to enable the connector member to be removed for engine replacement or repair. It can be appreciated that the connector member 22 in the illustrative embodiment of the snow thrower 10 provides rigidity and stability in a plane that is substantially perpendicular to the plane of the upper surface of the frame 14 on which the engine 12 is mounted and to the axis of rotation of the drive shaft 26.

Figure 2:
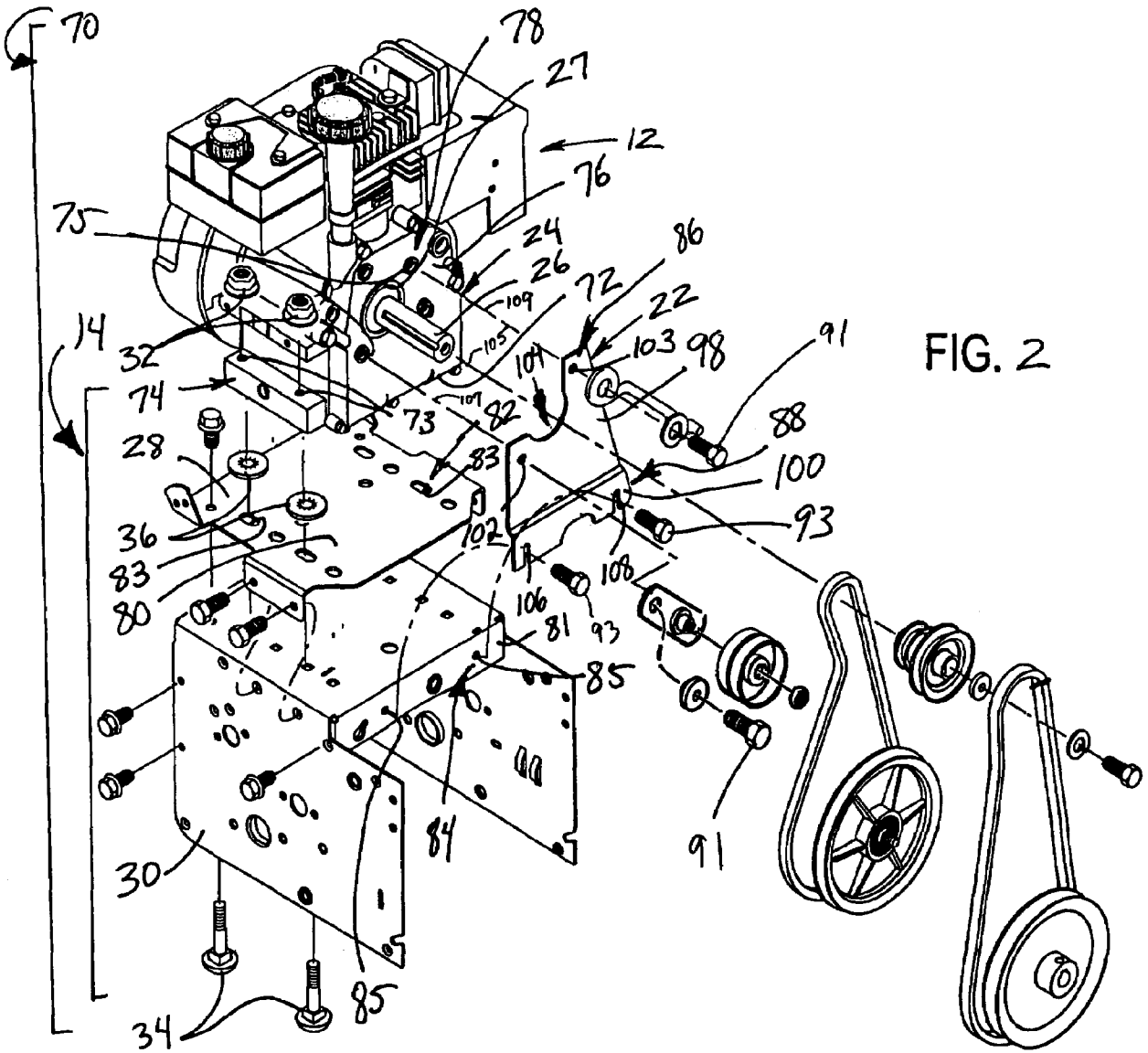
FIG. 2 is an exploded view of a portion of the snow thrower of FIG. 1 including an internal combustion engine, a frame, and a vibration reducing structure constructed to the mounted to the engine and the frame.
Figure 3:
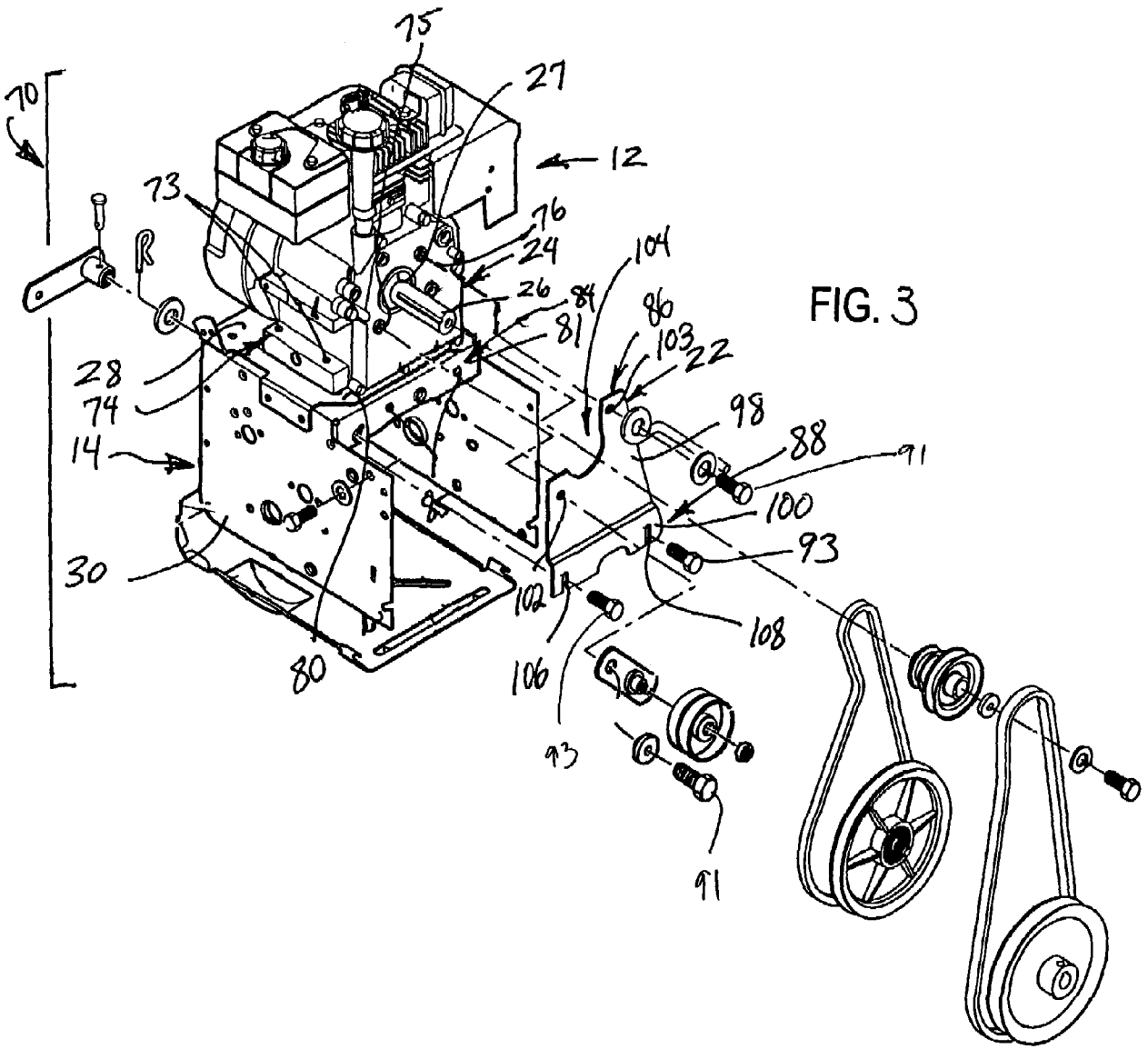
FIG. 3 is a view similar to FIG. 2, FIG. 3 showing the engine mounted on the frame and showing various components including the vibration reducing structure in exploded relation to the engine.
Figure 4:
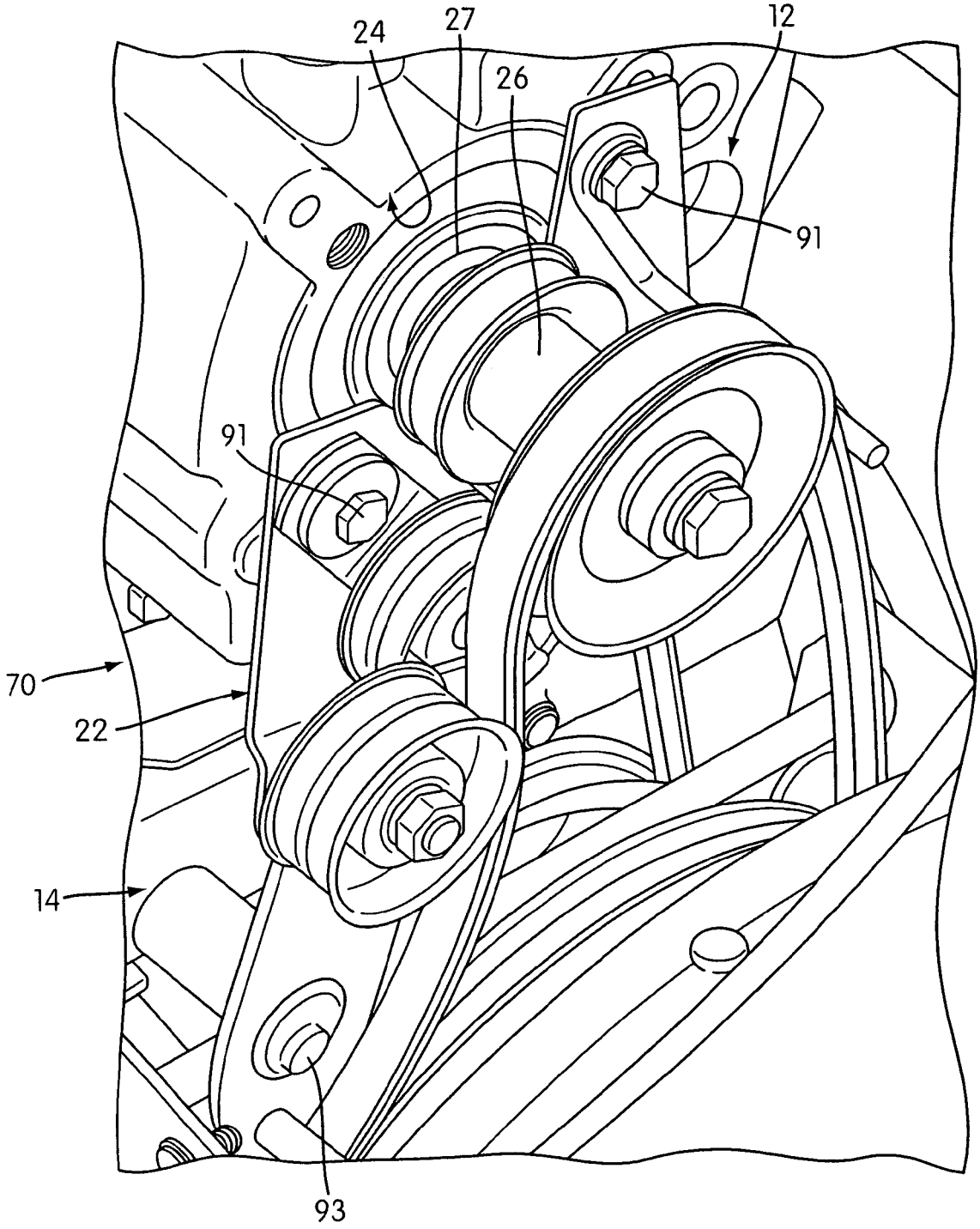
FIG. 4 is a perspective view of the assembled snow thrower showing the vibration reducing structure mounted to the engine and to the frame.
Figure 6:
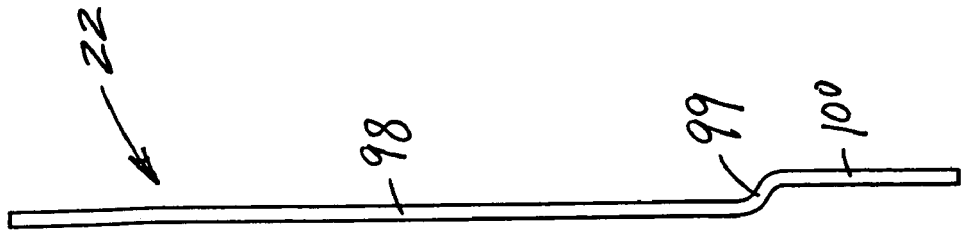
FIG. 6 is a side view of the vibration reducing structure in isolation.
Figure 5:
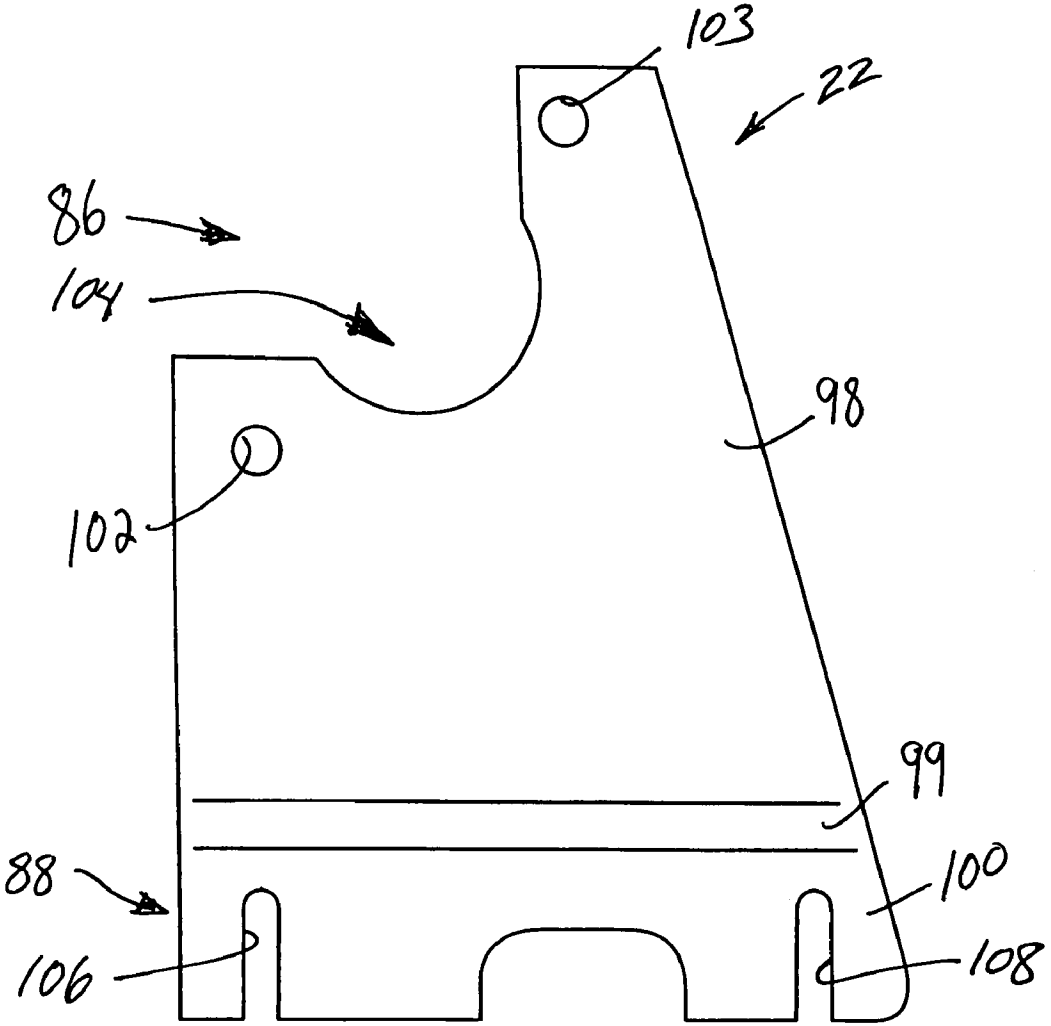
FIG. 5 is an elevational view of the vibration reducing structure in isolation.

The connecting member 22 is coupled between the engine block 26 and the engine mounting structure 14 in a manner which can be understood from FIGS. 2–4. As shown, for example, in FIGS. 5 and 6, the connecting member 22 is a one-piece, unitary member which may be constructed of a sheet of metal of appropriate strength (e.g., aluminum or steel) and shaped by stamping or other appropriate metal forming methods. The connecting member 22 includes an engine portion 98 and an engine mount portion 100. In the illustrative embodiment, the engine portion 98 and the engine mount portion 100 are both substantially planar structures and are separated from one another by an intermediate portion 99 that extends angularly therebetween.

The connecting member 22 is shaped so that the engine portion 98 conforms to and covers a portion of the engine side surface 76 and so that the engine mount portion 100 conforms to and covers a portion of the side surface 81 of the engine mounting structure 14 when the connecting member 22 is mounted on the engine 12 and the engine mounting structure 14. In the illustrative embodiment, the engine portion 98 and the engine mount portion 100 are substantially parallel to one another, but this is illustrative only and not required.

The connecting member 22 includes a pair of connecting member fastener elements that facilitate connection of the connecting member 22 to the engine 12 and the engine mounting structure 14. A first connecting member fastening element 86 is formed on the engine portion 98 of the connecting member 22. The first connecting member fastening element 86 is comprised of two block connector apertures 102, 103. An open-ended slot 104 is positioned between the two block connector apertures 102, 103. The open-ended slot 104 has a perimeter that is open at one end or one side. When the connecting member 22 is mounted on the engine mounting assembly 70, the drive shaft 26 is positioned in the open-ended slot 104. Each of the two block connector apertures 102, 103 has an imaginary axis 107, 109, respectively, that extends therethrough. The open-ended slot 104 is constructed and arranged such that a straight line intersecting each of the imaginary axes 107 and 109 of the block connector apertures 102, 103 also passes through the open-ended slot 104.

A portion of the perimeter of the open-ended slot 104 includes an arc of a circle. In one preferred embodiment of the invention, the imaginary axis 105, formed at the center of the circle defined by the arc of the open-ended slot 104, is positioned an equal distance from the axes of the two block connector apertures 102, 103. Also, the axis 105 is colinear with the axis of the drive shaft 26. In the illustrative embodiment, the two block connector apertures 102, 103 are spaced 180 degrees apart from one another around the axis of the circle 105.

A second connecting member fastening element 88 is formed on the engine mount portion 100 of the connecting member 22. The second connecting member fastening element 88 is comprised of a pair of two mount connector apertures 106, 108. Each of the two mount connector apertures 106, 108 may have one of many different constructions. For example, each mount connector aperture 106, 108 may be a circular opening, may be an elongated or oval opening, or each may be an open-ended slot as shown in the illustrative embodiment having a perimeter that is open at one end.

When the connecting member 22 is mounted on the engine 12 and the engine mounting structure 14, the two block openings of the engine side fastening element 78 are each fastened to a respective one of the two block connector apertures of the first connecting member fastening element on the connecting member 22 by a block fastener. Each block fastener may be a bolt 91. The two block openings are positioned 180 degrees apart from one another on opposite sides of the axis 105 defined by the open-ended slot 104 and on opposite sides of the drive shaft 26 longitudinal axis 105. The connecting member 22 is mounted on the engine 12 such that the axis 105 of the open-ended slot 104 coincides with the longitudinal axis of the drive shaft 26. Each of the two block openings is radially spaced from the longitudinal axis by a radius, and the radius for one of the two block openings is the same as the radius for the other of the two block openings.

Similarly, when the connecting member 22 is mounted on the engine 12 and the engine mounting structure 14, the two mount openings of the mount side fastening element 84 are each fastened to a respective one of the two mount connector apertures on the connecting member 22 by a pair of mount fasteners 93. Each mount fastener may be a threaded fastener such as a screw or a bolt 93. The bolt 93 may use a nut or may be used without a nut if one the openings into which the bolt 93 proceeds is threaded.

Although the connecting member 22 is illustrated as being connected by two fasteners 91 to the engine block 12 and by two fasteners 93 to the engine mount 14, it should be understood that depending on the availability of accessible openings on the engine and the amount of vibration reduction capabilities desired from the connecting member 22, the only one faster 91 may be employed to connect the engine 12 to the connecting member 22, or more than two fasteners 91 may be used. Similarly, only one faster 93 may be employed to connect the connecting member 22 to the mount 14, or more than two fasteners 93 may be used. Further, the number of fasteners 91 used to fasten the connecting member 22 to the engine 12 may be different than the number of fasteners 93 used to connect the connecting member 22 to the mount 14. Additionally, although fasteners such as bolts 91 and 93 are illustrated other types of fasteners may be employed, including other types of threaded fasteners, non-threaded fasteners, and fastening mechanisms such as latches, connections, and welding. Further, it should be understood that the configuration of the connecting member 22 may change according to the specific configuration of the engine to which the connecting member may be attached and that the configuration and thickness and material of the connecting member 22 may vary depending on the level of vibration damping required.

Figure 8:
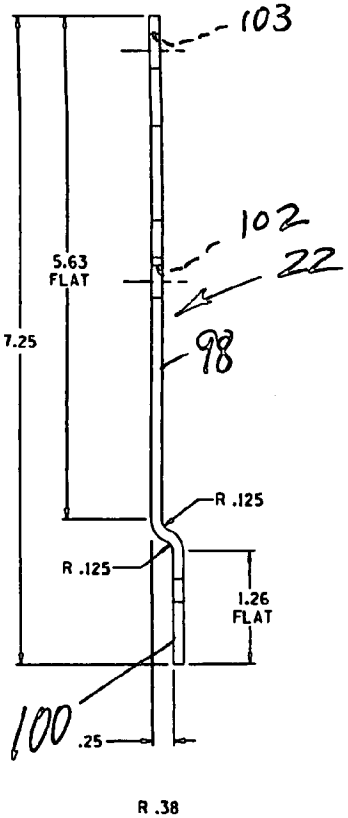
FIGS. 7 and 8 are reviews similar to FIGS. 5 and 6, respectively, except showing various illustrative dimensions of one illustrative embodiment of FIG. 1.
Figure 7:
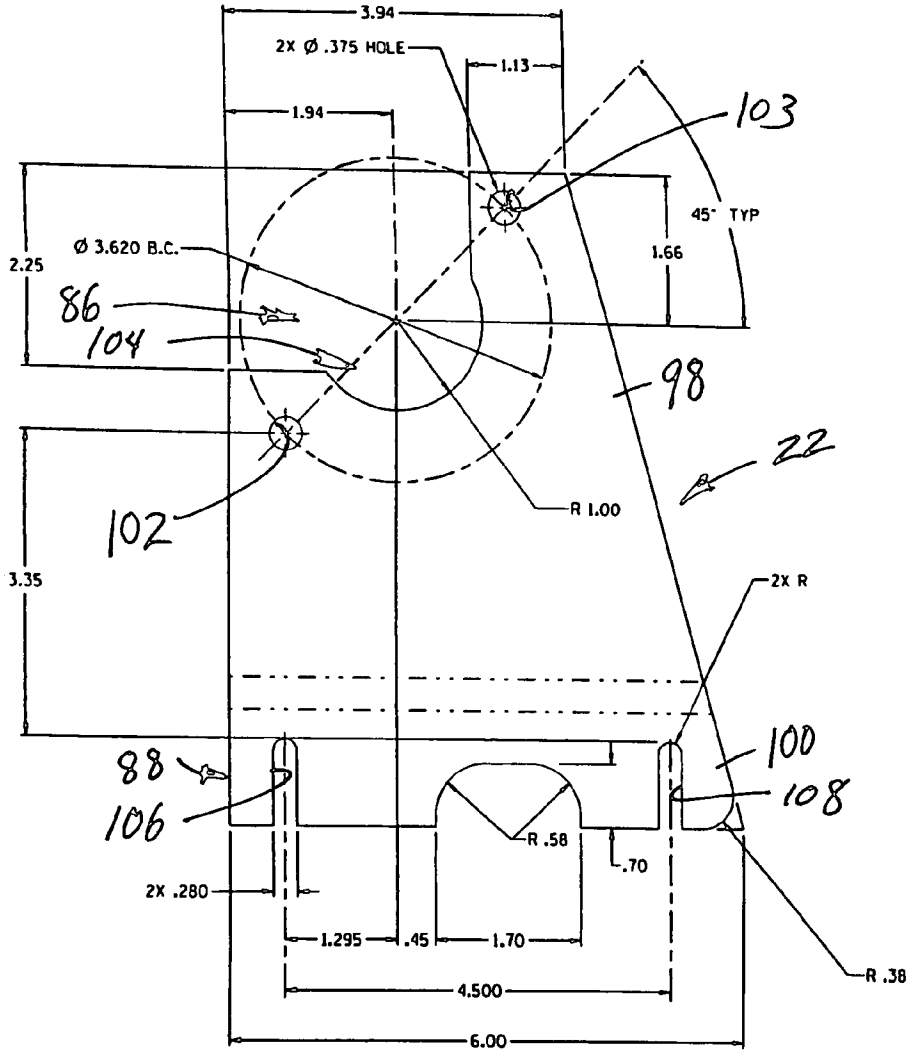

FIGS. 7 and 8 show the connecting member 22 with example linear, angular and radial measurements. The example linear measurements are given in inches and the example angular measurements are given in degrees. The connecting member 22 is approximately 7.25 inches in vertical height and approximately 4 inches in width at the top and 6 inches in width at the bottom. The illustrative connector member 22 is approximately wide enough to span the width of the engine block 26 and is approximately long enough in the vertical direction to span most of the vertical height of the engine block 26 and (see FIGS. 2–4, for example). The connector member 22 therefore covers most or substantially all of the side of the engine block to which it is attached. The connecting member 22 is operable to stabilize the engine and to reduce relative movement between the frame 14 and the running engine and thereby reduce the amount of vibration that is transmitted through out the snow thrower 10.

It can be appreciated that the principles of the present invention are not limited to snow thrower construction but can be applied to the construction of a wide range of power operated tools and machines. It can also be appreciated that the shape and structure of the connector member 22 and the manner in which it the connector member 22 is mounted on the engine 12 and the engine mounting structure are illustrative only and are not intended to limit the scope of the invention. Other constructions and other arrangements are contemplated. For example, a connector member could be mounted on another side of the engine and the engine mounting structure as an alternative to or in addition to the side out of which the drive shaft extends, that is, on the front. Thus, in some embodiments, connector members may be mounted on more than one side of an engine.

Figure 9:
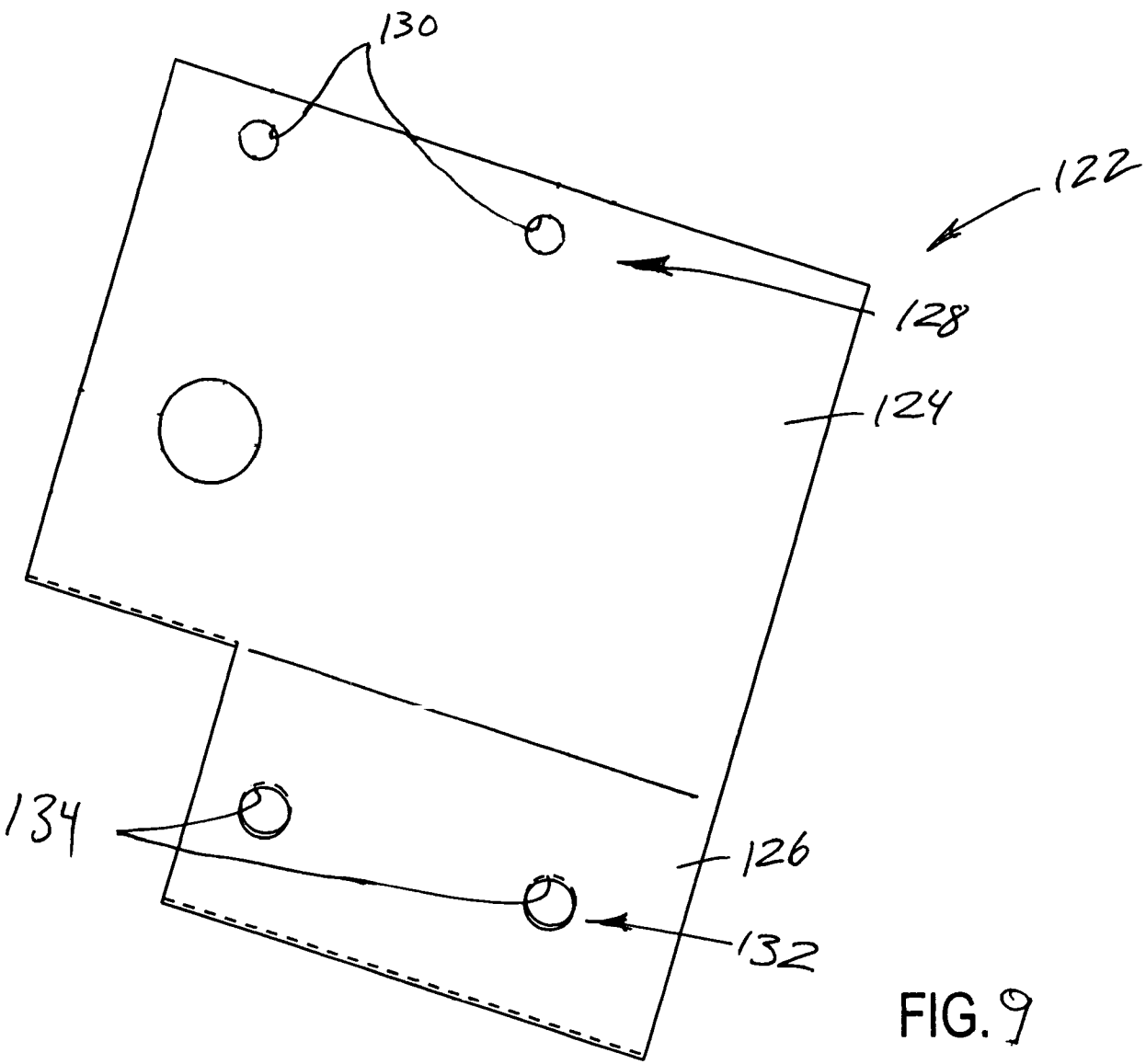
FIG. 9 shows another illustrative embodiment of a vibration reducing structure constructed in accordance with another illustrative embodiment of the present invention.
Figure 11:
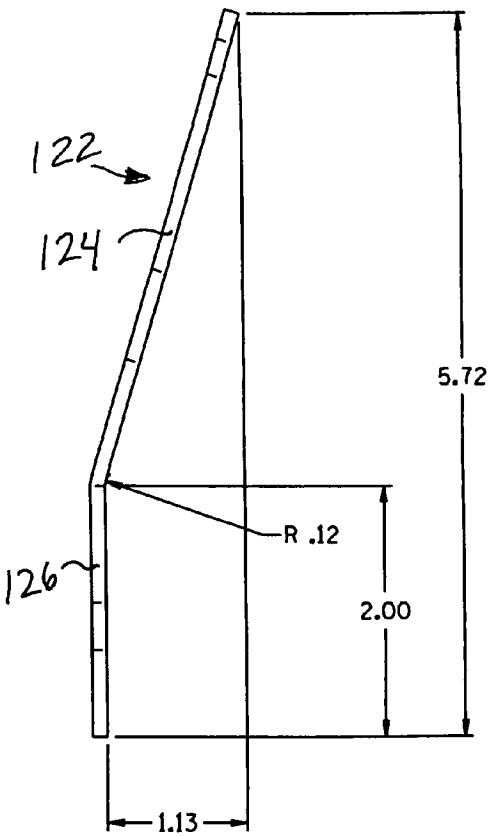
FIGS. 10–11 show another illustrative embodiment of a vibration reducing structure constructed in accordance with a another illustrative embodiment of the present invention similar to the embodiment of FIG. 9 but showing illustrative dimensions of one illustrative embodiment.
Figure 10:
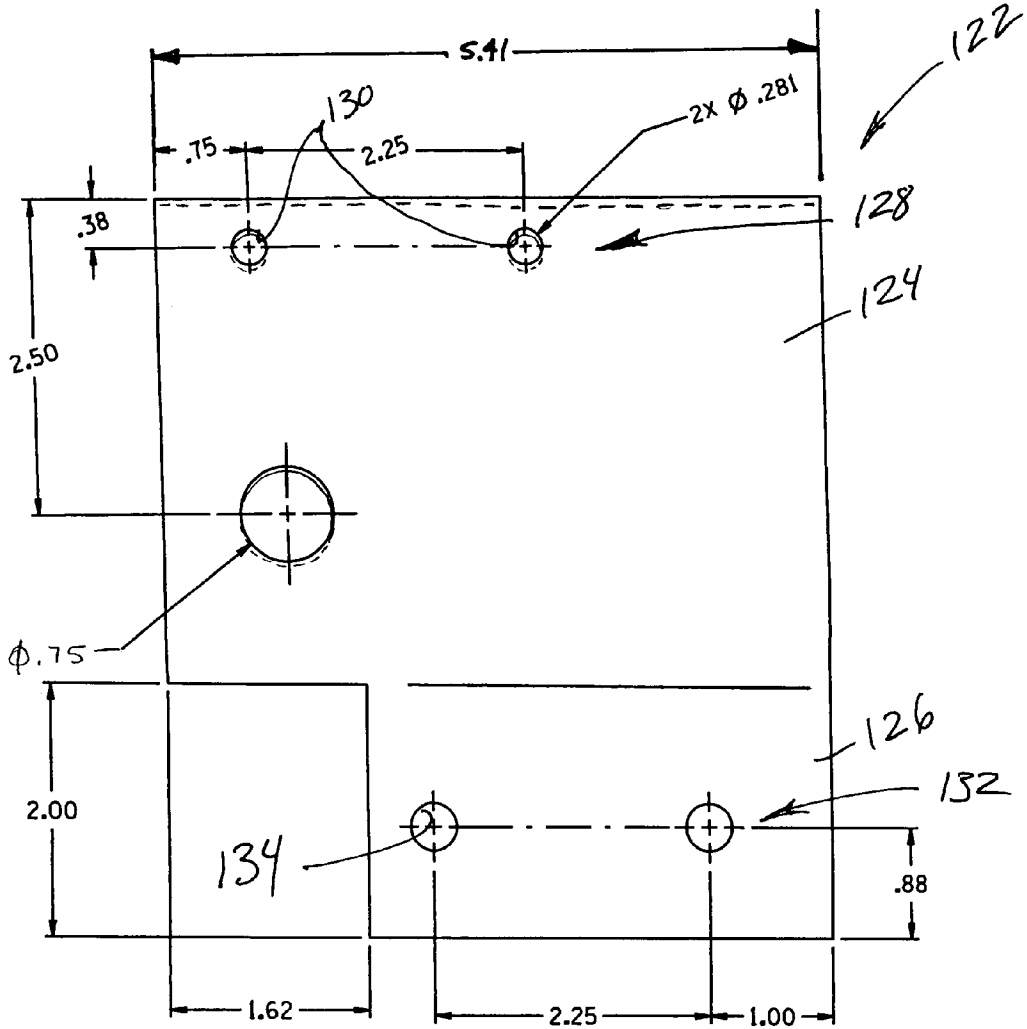

FIG. 9 shows another embodiment of connector member 122 and FIGS. 10 and 11 another embodiment with illustrative dimensions. The figures show examples of a connector member 122 that may be mounted on a side of the engine that is generally parallel to the longitudinal extent of the drive shaft of the engine. The connector member 122 may be an integral, one-piece metallic structure that includes an essentially planar engine mounting portion 124 and an essentially planar frame mounting portion 126. An engine mounting element 128 to the form of a pair of openings 130 are formed in the frame mounting portion 124 and a frame mounting element 132 in the form of a pair of openings 134 are formed in the frame mounting portion 126. The engine mounting portion 124 extends angularly from the frame mounting portion 126 (see FIG. 11, for example). The connector member 122 may be constructed and mounted such that each planar portion 124, 126 is secured to a corresponding planar surface portion on the engine and the engine mount or frame, respectively. The connecting member 122 may be secured to an engine and engine mount using fasteners (e.g., bolts with or without nuts, screws). Example measurements in inches and degrees are shown in FIGS. 9–11.

Figure 12:
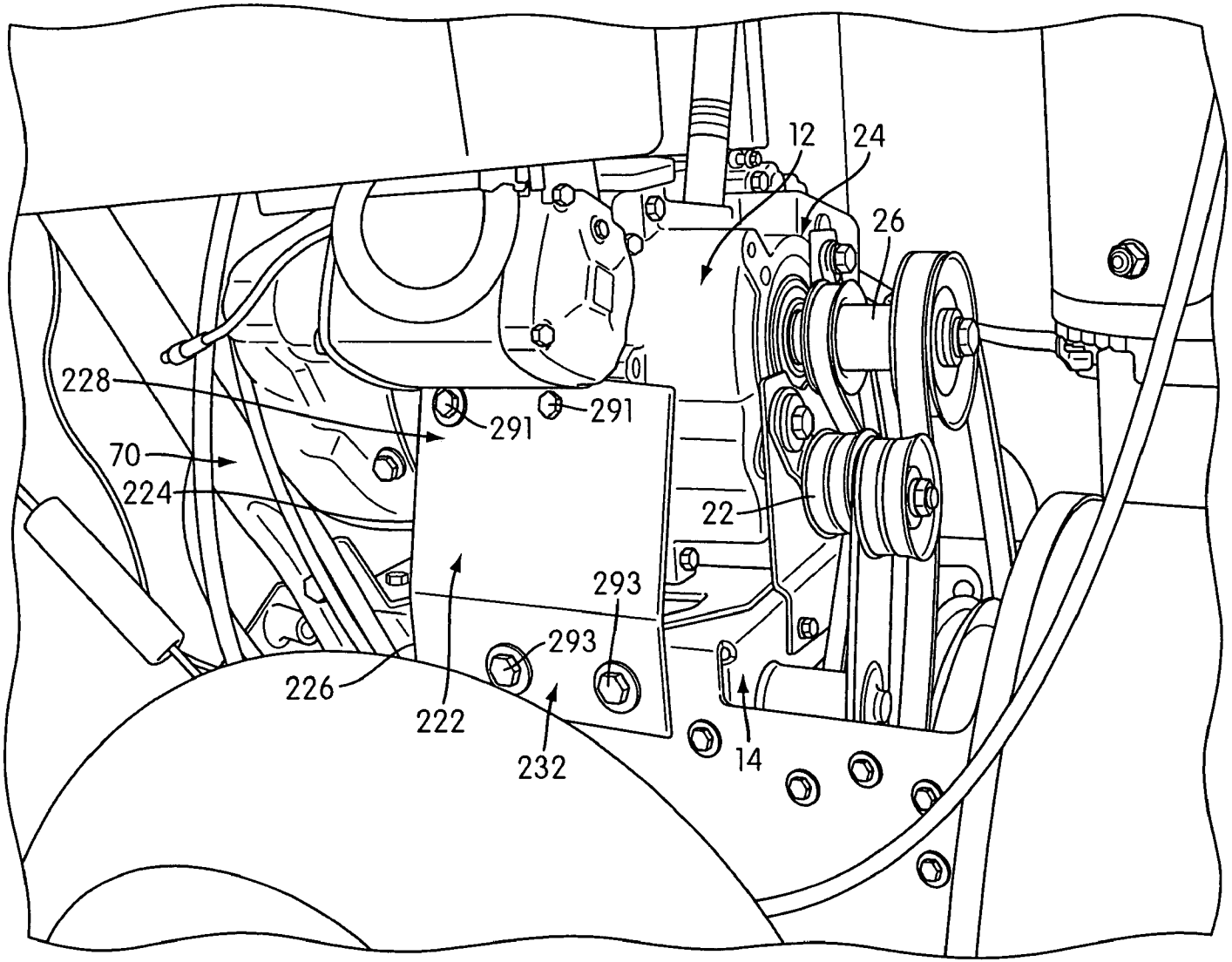
FIG. 12 shows another illustrative embodiment of a vibration reducing the structure constructed in accordance with a third illustrative embodiment of the present invention.

FIG. 12 shows a third embodiment of a connecting member. The connecting member 222 illustrated in FIG. 12 is substantially identical to connecting member 122 of FIGS. 9–11 except that member 222 is substantially rectangular in side elevational view and does not have a square opening as in FIG. 9, and FIG. 12 is substantially solid and without openings other than the openings for fasteners. In particular, FIG. 12 shows an example of a connector member 222 that may be mounted on a side of the engine that is generally parallel to the longitudinal extent of the drive shaft of the engine. The connector member 222 may be an integral, one-piece metallic structure that includes an essentially planar engine mounting portion 224 and an essentially planar frame mounting portion 226. An engine mounting element 228 to the form of a pair of openings are formed in the frame mounting portion 224 and a frame mounting element 232 in the form of a pair of openings are formed in the frame mounting portion 226. The engine mounting portion 224 extends angularly from the frame mounting portion 226. The connector member 222 may be constructed and mounted such that each planar portion 224, 126 is secured to a corresponding planar surface portion on the engine 12 and the engine mount or frame 14, respectively. The connecting member 222 may be secured to the engine 12 by use of bolts 291 and may be secured to engine mount 14 by use of bolts 293. Alternatively, other fasteners and fastening mechanism may be employed (e.g., bolts with or without nuts, screws).

It should be understood that where numerical dimensions have been given for certain illustrated embodiments, those dimensions are merely dimensions for certain, illustrated embodiments of the invention and should not be taken as limiting the respective embodiment to those dimensions specified.

Thus, while the invention has been disclosed and described with reference with a limited number of embodiments, it will be apparent that variations and modifications may be made thereto without departure from the spirit and scope of the invention and various other modifications may occur to those skilled in the art. Therefore, the following claims are intended to cover modifications, variations, and equivalents thereof.

What is claimed is:

1. An engine mounting assembly, comprising:

an engine block including an engine bottom surface having an engine bottom fastening element and an engine side surface having an engine side fastening element, said engine bottom surface being transverse to said engine side surface;

an engine mounting structure including a mount upper surface having a mount upper fastening element and a mount side surface having a mount side fastening element, said engine bottom fastening element being fastened to said mount upper fastening element, said mount upper surface being transverse to said mount side surface;

a connecting member coupled between said engine block and said engine mounting structure, said connecting member having a first connecting member fastening element and a second connecting member fastening element, said first connecting member fastening element being fastened to said engine side fastening element and said second connecting member fastening element being fastened to said mount side fastening element, wherein said engine side fastening element includes two block openings, said first connecting member fastening element includes two block connector apertures, and each of said two block openings are fastened to a respective one of said two block connector apertures by a block fastener, said mount side fastening element includes two mount openings, said second connecting member fastening element includes two mount connector apertures, and each of said two mount openings are fastened to a respective one of said two mount connector apertures by a mount fastener, and wherein each of said two mount connector apertures are slots.

2. An assembly according to claim 1, wherein each of said two slots are open-ended such that each of said two slots has a perimeter that is open at one end.

3. An engine mounting assembly, comprising:

an engine block including an engine bottom surface having an engine bottom fastening element and an engine side surface having an engine side fastening element, said engine bottom surface being transverse to said engine side surface;

an engine mounting structure including a mount upper surface having a mount upper fastening element and a mount side surface having a mount side fastening element, said engine bottom fastening element being fastened to said mount upper fastening element, said mount upper surface being transverse to said mount side surface;

a connecting member coupled between said engine block and said engine mounting structure, said connecting member having a first connecting member fastening element and a second connecting member fastening element, said first connecting member fastening element being fastened to said engine side fastening element and said second connecting member fastening element being fastened to said mount side fastening element; and a drive shaft positioned within said engine block and protruding outwardly from said engine block from a drive shaft opening in said engine block, and wherein said engine side fastening element includes two block openings, said first connecting member fastening element includes two block connector apertures, and each of said two block openings are fastened to a respective one of said two block connector apertures by a block fastener, said two block openings being positioned on opposite sides of said drive shaft.

4. An assembly according to claim 3, wherein said drive shaft has a longitudinal axis and each of said two block openings is radially spaced from said longitudinal axis by a radius, and said radius for one of said two block openings is the same as said radius for the other of said two block openings.

5. An assembly according to claim 4, wherein said two block openings are spaced 180 degrees apart around said longitudinal axis.

* * * * *